United States Patent [19]

Sapien

[11] 4,151,929

[45] May 1, 1979

[54] PLASTIC LINER WITH COLLAR FOR A PAINT RECEPTACLE

[76] Inventor: Sisto V. Sapien, P.O. Box 185, Lynnwood, Wash. 98036

[21] Appl. No.: 825,062

[22] Filed: Aug. 16, 1977

Related U.S. Application Data

[63] Continuation of Ser. No. 703,802, Jul. 9, 1976, abandoned.

[51] Int. Cl.[2] ..... B65D 25/16; B65D 41/06; B65D 41/18; B65D 51/18

[52] U.S. Cl. ..... 220/404; 220/256; 220/298; 220/307; 220/367; 220/373; 222/183

[58] Field of Search ..... 220/373, 63 R, 256, 220/17, 296, 23, 404, 367, 307, 298; 222/95, 105, 107, 183

[56] References Cited

U.S. PATENT DOCUMENTS

| | | | |
|---|---|---|---|
| 659,150 | 10/1900 | King | 220/23 |
| 690,441 | 1/1902 | King | 220/23 |
| 1,444,043 | 2/1923 | Slocomb | 220/23 |
| 2,198,125 | 4/1940 | Nelson | 220/256 |
| 2,661,862 | 12/1953 | Howe | 220/296 |
| 2,788,926 | 4/1957 | Morrison | 220/65 |
| 2,868,410 | 1/1959 | Henchert | 220/307 |
| 3,015,410 | 1/1962 | Everett et al. | 220/63 R |
| 3,158,282 | 11/1964 | Housz | 220/63 R |
| 3,163,544 | 12/1964 | Valyl | 220/63 R |
| 3,211,324 | 10/1965 | Sapien | 220/63 R |
| 3,227,305 | 1/1966 | Enssle | 220/63 R |
| 3,401,842 | 9/1968 | Morrison | 222/95 |
| 3,587,940 | 6/1971 | Ellis | 222/542 |
| 3,773,211 | 11/1973 | Bridgman | 220/63 R |
| 3,805,991 | 4/1974 | Cheladze et al. | 220/373 |

*Primary Examiner*—William Price
*Assistant Examiner*—Allan N. Shoap
*Attorney, Agent, or Firm*—Graybeal, Barnard & Uhlir

[57] ABSTRACT

A disposable liner for the paint container of a conventional spray gun having a liner body formed from a pliable sheet material sized and shaped to closely fit the interior of the paint container and an annular collar formed from a more rigid plastic material secured near the open end of the liner body. The annular collar includes a cylindrical sidewall sized to snugly fit within the neck portion of the paint receptacle. A throw-away lid is also provided for closing the disposable liner and it is adapted to snugly fit a draw tube of the paint spray gun until it is forceably removed. The stiff plastic collar mates with the lid and allows repeated opening of the paint receptacle without ripping or tearing of the liner body in order that it might be refilled with paint as needed. In an alternative embodiment, a pair of locking means are provided on either side of both the collar and the lid of the liner. The mating parts of each locking means are adapted to be unengaged when the yoke of the paint spray gun is both in its closed position against the lugs at the top of the paint receptacle and in its released position with the yoke rotated just free of the lugs. However, if the yoke is aligned over the paint receptacle in a third position, such as on the side of the lugs opposite the released position, the parts of the locking means can be mated so that the paint covered disposable liner can withdraw from the paint receptacle.

11 Claims, 6 Drawing Figures

Fig. 1.
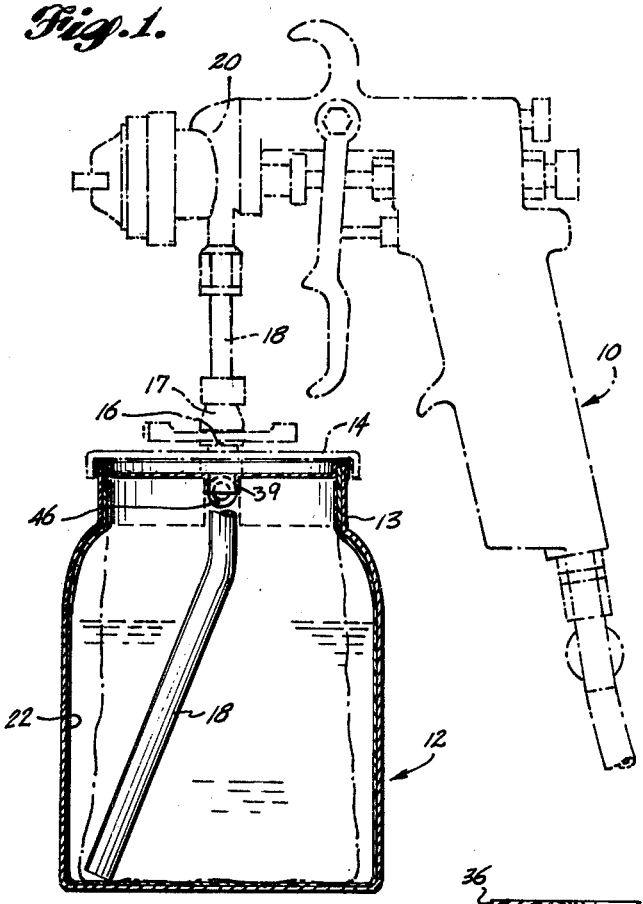
Fig. 2.
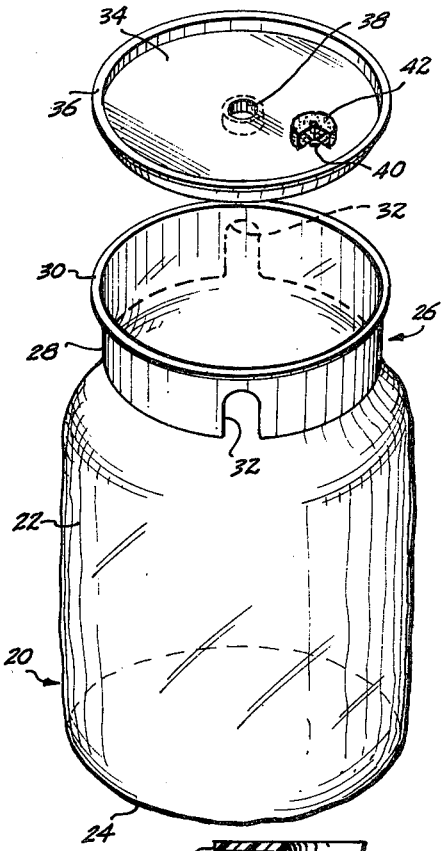
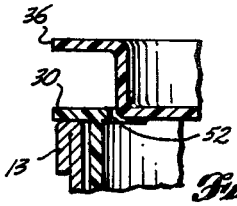
Fig. 5.
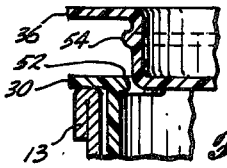
Fig. 6.
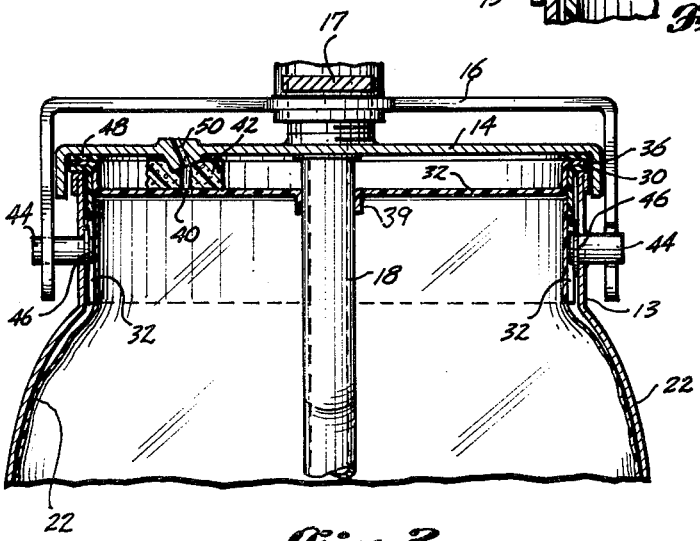
Fig. 3.
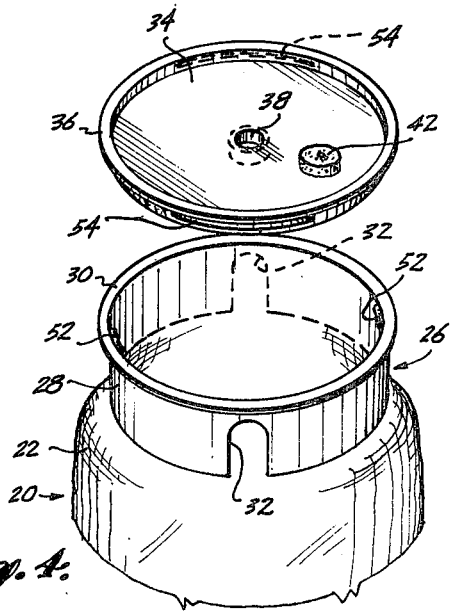
Fig. 4.

PLASTIC LINER WITH COLLAR FOR A PAINT RECEPTACLE

This is a continuation of application Ser. No. 703,802, filed July 9, 1976, now abandoned.

BACKGROUND OF THE INVENTION

1. Field of the Invention

This invention relates to a disposable liner having a stiff collar positionable in a paint receptacle of a pneumatic paint spray gun to minimize cleanup time.

2. Description of the Prior Art

A significant problem involved with the use of pneumatic type paint spray guns in which paint is positioned in a receptacle attached thereon is that such receptacle must be frequently cleaned, either to change colors or at the end of each job. This problem is particularly acute in commercial paint spray shops wherein a large number of spray guns are used and each paint receptacle must often be refilled repeatedly. However, at the completion of each job the paint spray gun and paint receptacle must be cleaned prior to starting the next job. Furthermore, it is often necessary to clean the spray gun more frequently such as each time paint of a different color is to be used therein or at the end of each work period to prevent paint from drying or hardening on the component parts of the spray gun or when the spray gun is going to be inactive for any extended period of time. As is well known, cleaning of the spray gun and paint receptacle is an unpleasant task requiring time and labor and often a substantial amount of cleaning solution or other paint soluble substance.

Of particular interest with respect to a prior art liner adapted for use in the paid receptacle of a spray gun is U.S. Pat. No. 3,211,324 to S. Sapien, granted Oct. 12, 1965. The liner disclosed in this patent, my prior patent, included a structure formed of a pliable sheet material shaped to closely fit the interior of the paint receptacle. That liner had an open top and included an annular collar which fit adjacent to and external of the neck of the paint receptacle. Accordingly, the receptacle cover engaged the thin relatively weak pliable material forming the body portion of the liner. It has been found that if the receptacle cover is frequently removed, such as would be the case in a commercial spray shop, that portion of the liner body between the cover and the top of the receptacle tends to rip or tear as the result of the rotational movement between the cover and top of the paint receptacle. This damage, in turn, rendered the liner less effective in minimizing cleanup time and labor.

Other examples of prior art of general interest are U.S. Pat. Nos. 2,788,926 to L. Morrison granted Apr. 16, 1957; 2,671,907 to R. Sterling granted Mar. 16, 1954, and 3,128,904 to H. Reilly granted Apr. 14, 1964.

SUMMARY OF THE INVENTION

According to an aspect of the present invention, a disposable paint receptacle liner having a stiff collar is provided which receives and holds the paint therein preventing it from contacting and adhering to the inside of a conventional paint receptacle thereby minimizing the time and labor required to clean such paint holding receptacle.

According to another aspect of the invention, a disposable liner for a paint receptacle is provided with a collar of a more stiff plastic which is insertable in the neck of a paint receptacle so that the paint receptacle can be repeatedly opened and refilled without damaging or otherwise rendering ineffective the paint holding capability of the liner.

According to yet another aspect of the invention, a liner for a conventional paint spray gun is provided with a lid having a central opening sized to fit snugly on the draw pipe extending through the cover for a paint receptacle so that it remains adjacent the underside of the cover when the paint receptacle, with a liner body and collar therein, is detached from the spray gun. This prevents the disposable liner lid from interfering with routine filling of the paint receptacle, and yet it can be quickly removed therefrom in cleaning the paint spray gun.

According to still another aspect of the invention, an alternative embodiment of a liner according to the instant invention is provided with a lock means which can be used to remove the liner body from the paint receptacle. Each first part of the lock means is situated on diametrically opposed sides of the collar at the top of the liner body and each second part of the lock means is situated on either side of the lid which closes the liner. By orienting the yoke assembly of the spray paint gun in a third position, distinct from its normally locked or unlocked position, the first and second parts of the locking means on either side of the collar can be snapped into engagement allowing the liner body to be withdrawn from the paint receiving container of the spray gun.

Other objects of the invention will be apparent from the following description taken in connection with the accompanying drawings.

BRIEF DESCRIPTION OF THE DRAWINGS

FIG. 1 is an elevational view, in section, illustrating a liner in accordance with the instant invention shown in the paint container of a conventional paint spray gun, the spray head portion of the gun being shown in broken line;

FIG. 2 is a pictorial view showing the paint liner of the instant invention with the lid exploded therefrom;

FIG. 3 is an enlarged fragmented view of FIG. 1 illustrating the cooperation of the liner collar with the paint receptacle and cover of the paint spray gun; and FIG. 4 is a pictorial view of an alternative embodiment of a liner according to the instant invention which includes a locking means situated on the lid and collar of the liner for removal of the used liner from the paint receptacle.

FIG. 5 is a fragmented view of an edge portion of the liner collar and lid illustrating the locking means in a nonengaging alignment; and FIG. 6 is a fragmented view of the same edge portion of the liner collar and lid, but illustrating the locking means is an engaging alignment.

DESCRIPTION OF THE PREFERRED EMBODIMENT

Referring initially to FIG. 1, a conventional paint spray gun 10 is illustrated including a paint receptacle 12 having a lesser diameter neck 13 in which paint to be sprayed through the final outlet orifice of the gun is initially poured. A cover 14 is attached through a yoke assembly 16 to a draw tube 18. A horizontal slot is provided near the end of each arm of yoke assembly 16 and each slot engages a laterally extending lug bolt attached near the top of paint receptacle 12. Rotation of thumb bolt 17 drives cover 14 against the top of paint receptacle 12 sealing it, hereinafter described in greater detail. As is best seen in the drawing, draw tube 18 is normally attached at its upward end to head 20 of spray gun 10 and is of sufficient length to extend to the bottom of paint container 12 so that paint disposed therein can be withdrawn by the siphon effect created when spray gun 10 is actuated.

Now referring to FIG. 2 in conjunction with FIG. 1, one embodiment of a disposable liner according to the instant invention will be described. In preferred form, liner 20 comprises a bag-like body 22 formed preferably from a single ply pliable material which is impervious to paint. The body is essentially a cylinder with a closed bottom 24 at one end and, at its opposite end, a lesser diameter open neck so that liner 20 is essentially sized and shaped to conform to the interior of paint receptacle 12.

At the top of liner 20 an annular collar 26 of a stiffer, less pliable plastic substance is provided and secured to the neck at the top of body 22 by a known method. Collar 20 includes cylindrical sidewall 28 and annular lip 30 secured at the top thereof. Lip 30 extends radially outwardly between cover 14 and the top of paint receptacle 12 so that the liner will be sealed against paint leakage. A pair of diametrically opposed vertical slots 32 are formed in sidewall 28 and open downwardly. Each slot 32 is sized to receive and cooperate with lugs mounted in neck 13 of paint receptacle 12, hereinafter described in greater detail, to prevent rotation of collar 26 when moving cover 14 to its locked position.

In preferred form, a lid 34 is provided which is suitably sized to snugly fit in the top of collar 26. As is best seen in FIG. 2, lid 34 is preferably shaped as a shallow dish and includes an annular lip 36 which is of a sufficient diameter to extend radially outwardly over the top of paint receptacle 12. This allows lid 34 to close liner body 22 and seal the liner, as will be described in greater detail hereinafter. An opening 38 is provided in the center of lid 34, and it is bounded by an annular collar 39 sized to snugly engage draw tube 18 so that it will remain thereon during repeated filllings of paint receptacle 12. An air vent 40 is provided in lid 34 radially outwardly of central opening 38. A ring of absorbent material 42, such as an open-celled foam, is attached to the upper surface of lip 34 around air vent 40 to absorb and hold any paint which passes through air vent 40 in the event the spray gun is tipped or tilted toward a horizontal orientation in use.

As indicated herebefore, a particular advantage of the liner according to the instant invention is that paint receptacle 12 can be opened and refilled repeatedly during a painting process without ripping or tearing of the pliable material forming the liner body. However, it is still sufficiently inexpensive to make so that it can be discarded either at the end of each day, when changing to a different color of paint, or when otherwise cleaning the spray gun.

Another key feature of the lining according to the instant invention is that it is particularly adapted to minimize the time and labor involved in cleaning a conventional paint spray gun. Referring now primarily to FIGS. 2 and 3, the use of the liner according to the instant invention will now be described. Liner 20 is provided to a customer as a unit having two separate components, one being liner body 22 including collar 26 attached thereto and the other being lid 34. As is best seen in FIG. 3, paint receptacle 12 is normally provided with closing means which may include a pair of laterally extending lugs 44 attached to and extend through neck 13 of receptacle 12. The inward ends of lug bolts 44 face each other and each end may include a washer 46 clamped between the end of each bolt 44 and the sidewall of neck 13. Initially, opening 38 in the center of lid 34 is inserted over the end of pipe 18 until it is seated against lid gasket 48 on the underside of cover 14. If desired, air vent 40 may be aligned with an air breather opening 50 through cover 14 so that air can flow freely into the interior of paint receptacle 12 as paint is withdrawn. Next, liner body 20 is disposed over the open end of paint receptacle 12 so that each vertical slot 32 in collar 26 is aligned with one of the laterally extending lugs 44. Collar 26 can now be inserted into neck 13 until lip 30 is seated against the top of paint receptacle 12. Paint receptacle 12 is now ready to receive paint therein.

After an appropriate amount of paint has been poured into the paint receiving container, cover 14 can then be seated on receptacle 12. Neck 13 is initially disposed adjacent the underside of cover 14 in contact with lid 34, already mounted against the underside of cover 14 on draw tube 18. The slots at the end of each arm of yoke 17 are then rotated into engagement with laterally extending lugs 44. Locking device 16 is rotated until cover 14 is firmly seated against neck 13 of paint container 12. Paint spray gun 10 can now be used in a conventional manner.

As is known, the paint containers of conventional spray guns have a limited capacity and must be frequently refilled in use, particularly in large scale operations such as a commercial paint spray shop. Accordingly, it is important that paint container 12 be quickly refillable and yet liner 20 must be sufficiently durable so that it will not be damaged each time cover 14 is separated from the paint receptacle. As can be best seen in FIG. 3, when it is necessary to refill paint container 12, cover 14 is unlocked in the reverse manner as just described. The slots in the arms of yoke 17 can then be rotated free of laterally extending lugs 44 and spray gun head 20 and tube 18 withdrawn from the paint receptacle. Since lid 34 is snugly fitted to draw pipe 18, it remains against the underside of cover 14. Additional paint can now be poured into container 12 and spray gun head 20 remounted as heretofore described. Of course, in order to clean the spray gun, either to change colors or at the end of a particular job, both liner body 22 can be removed from container 12 and lid 34 from pipe 18 so that time and labor involved in cleaning the spray gun is reduced.

Referring now to FIG. 4, an alternative embodiment of a liner for a spray gun according to the instant invention will be seen. For ease of illustration, only the upper portion of pliable liner body 22, collar 26 and lid 34 is illustrated; however, it should be understood that these components cooperate with paint receptacle 12 and cover 14 in the same manner as herebefore described to close the paint receiving container. In preferred form, this embodiment is provided with at least one pair of locking means 52, 54, each locking means being situated at the top of the liner 20 diametrically opposite the other so that it is in rotational symmetry. Preferably, each locking means comprises a first part 52 situated on the top of collar 26 facing inwardly and a second part 54. As is best seen in FIG. 6, second part 54 is situated on the peripheral portion of lip 54 and faces outwardly slightly below lip 36. Both locking means are so situated around the circumference of collar 26 that first part 52 and second part 54 are not engaged when yoke assembly 16 is in its closed position against lugs 44, i.e. FIG. 5. In addition, first part 52 and second part 54 remain unengaged when yoke assembly 16 is rotated sufficiently so that the slots in each arm are free of lugs 44. Accordingly, paint receptacle 12 can then be opened and refilled or liner 20 removed in the manner heretofore described in conjunction with the first embodiment without interference of the locking means.

However, since the inside of collar 26 and liner body 22 after use are often coated with paint residue, a particular advantage of this second embodiment of the instant invention is that locking means 52, 54 can be used to withdraw both collar 26 and liner body 22 from paint receptacle 12 without touching the liner interior. Accordingly, in order to cause a mating of locking means 52, 54, yoke 16 is initially vertically aligned over neck 13 of paint receptacle 12 on the side of lugs 44 opposite the released position. Lid 14 is then moved downwardly seating its under surface, with lid 34 attached thereto, against lip 30 of collar 26. As is best seen in FIG. 6, this movement causes second part 54 of the locking means attached to lid 34 to snap past the first part 52 projecting inwardly from the top of the inward surface of collar 26. Next, by separating cover 14 from paint receptacle 12, liner body 22 and collar 26 are withdrawn from paint receptacle 12 without otherwise touching the paint residue on the interior of the liner. Since the outside of liner 20 is free of residue paint, it can be easily handled so that it can be disposed of.

Still referring to FIG. 4, each first part 52 and second part 54 of the locking means preferably comprise a raised radially extending projection formed in the sidewall collar 26 and lid 34. Each projection extends circumferentially about one quarter of the distance around its respective cylindrical sidewall so the pair of locking means 52, 54 are oriented diametrically opposite. As is seen, mating of the parts of the locking means requires proper vertical alignment of lid 34 with respect to collar 26, this orientation is assured with regard to collar 26 by slots 32 engaging lugs 44 projected from neck 13 of paint container 12. Absorbent ring 42 is positioned around air vent 50 formed in cover 14 as lid 34 is fitted on draw pipe 18 so that each second part 54 of the locking means will be disposed for operation as hereabove described.

While in the preferred form according to the instant invention a pair of locking means 52, 54 are provided on either side of the separable part of liner 20, it should be understood that any number of locking means could be used so long as the mating parts are disposed in rotational symmetry around the periphery of liner collar 26 and lid 34.

As indicated herebefore liner body 22 is fabricated from a single ply of a strong, pliable and paint impervious material, such as plastic or the like. However, it should also be understood that if a liner of unusual strength is required, a laminated plastic material composed of a plurality of bonded plies may be used. In such a multiple ply construction, one of the plies may be fabricated from heavy paint which is treated or impregnated to render it less paint absorbent. The other plies could be a metal foil, such as tin or aluminum foil, or could alternatively be plastic. In any event the neck portion of the liner would be secured to the stiff plastic material forming collar 26 near the top of its internal sidewall.

In preferred form, collar 26 is only as long as the neck portion of paint receptacle 12 so that a number of liners 20 can be stacked compactly for shipment or storage. However, an individual liner can be quickly and easily grasped by its collar 26 and inserted into a paint receptacle as herebefore described.

The foregoing description and accompanying drawings illustrating examples of embodiments according to the instant invention are to be considered in all respects as illustrative and not restrictive, and the invention is not to be limited to the details given herein but should be considered within the scope of the appended claims.

What is claimed is:

1. For use with a paint sprayer comprising a paint container which is closed at its bottom end and which terminates at its top end in an open cylindrical neck portion having two diametrically opposite attachment pins projecting radially outwardly therefrom, said attachment pins having inner end portions which project radially inwardly a small amount into the opening formed by said cylindrical neck portion, a closure for said container, a spray gun mounted on said closure and including a draw tube which depends from said closure and in use extends into the paint container, and means for securing the closure to said container, including hook means carried by said spray gun operable for engaging the outward projecting portions of said attachment pins upon rotation of said closure from a first unlocked position in which the closure can be moved axially away from the container and a second locked position; a disposable liner for the paint container; comprising:

a rigid, thin-walled annular support collar comprising a cylindrical side wall sized to snugly fit inside the cylindrical neck portion of the paint container and a flange at its upper end which projects radially outwardly from the cylindrical side wall and in use rests on the upper end of the cylindrical neck portion of the paint container, said annular support collar including a pair of downwardly opening slots sized and spaced to snugly receive the radial inwardly projecting portions of the attachment pins, for holding the collar against rotation while the closure is being rotated; and a liner body formed from a thin pliable sheet of material and sized to closely fit the interior of said paint container, said liner body including a closed lower end adapted to rest on the bottom end of the paint container and an open upper end that is secured to said support collar.

2. A disposable liner according to claim 1, further comprising a removable lid which includes a main radial wall, a cylindrical peripheral wall extending upwardly from said main wall and sized to fit within the support collar, and an opening in said main wall sized to snugly fit about and frictionally grip the draw tube.

3. A disposable liner according to claim 2, for use with a closure which includes a vent opening spaced radially from the draw tube wherein the main wall of said lid includes a second opening spaced radially outwardly from said draw tube opening, to function as a vent opening, said vent opening in the lid being alignable with the vent opening in the closure.

4. A disposable liner according to claim 3, wherein said lid includes a seal ring attached to its upper surface about said opening, said seal ring projecting upwardly from said lid and terminating in an end surface which during use makes sealing contact with the inner side of the closure, about its vent opening, said seal ring serving to seal against paint leakage into the space between the lid and the closure.

5. A disposable liner according to claim 1, further comprising locking means operable for locking the lid to the support collar, so that the entire disposable liner can be withdrawn from the paint container by a movement of the closure away from the paint container.

6. A disposable liner according to claim 5, wherein said locking means comprises a plurality of circumferentially spaced apart, inwardly directed radial projections on an upper portion of said support collar, and complementary projections carried by the lid and positionable below said radial projections, in a position of vertical interference therewith, and wherein said complementary projections are movable into and out from a postion of vertical interference with said projections by a simple rotation of the lid relative to the support collar.

7. A disposable liner according to claim 1, further comprising locking means operable between a locked position, for locking the lid to the support collar, so that the lid, the support collar and the liner body can be withdrawn from the paint container by a movement of the closure away from the paint container owing to the frictional grip of said lid on said draw tube, and an unlocked position, in which the lid and the support collar are not locked together and only the lid is removed with the draw tube when the closure is moved away from the paint container.

8. A disposable liner according to claim 7, wherein said locking means comprises a plurality of circumferentially spaced apart, inwardly directed, radial, first projections on an upper portion of said support collar, and a plurality of complementary, circumferentially spaced apart, outwardly directed, radial, second projections carried by the lid and wherein when said locking means is in said unlocked position said first projections are circumferentially spaced apart from said second projections and when said locking means are in said locked position said first and second projections are circumferentially adjacent each other and are interlocked with each other by a snap fit.

9. For use with a paint sprayer comprising a paint container which is closed at its bottom end and terminates at its top end in an open cylindrical neck portion, a closure for said container, a spray gun mounted on said closure including a draw tube which depends from said closure and in use extends into the paint container, and means for securing the closure to said container; an improved disposable liner for the paint container of the type including:

an annular support member;

a liner body formed from a thin pliable sheet material and sized to closely fit the interior of said paint container, said liner body including a closed end adapted to rest on the bottom end of the paint container and an open end that is attached to said support member; and a removable lid for said liner which is separate from said liner, comprising a main radial wall, a cylindrical peripheral wall extending upwardly from said main wall and sized to fit downwardly within the support member, a draw tube opening in said main wall surrounded by an annular collar sized to snugly fit about and frictionally grip the draw tube, and a vent opening in said main wall; wherein the improvement comprises:

said support member including a rigid, thin-walled annular support collar comprising a cylindrical side wall sized to snugly fit downwardly inside of the cylindrical neck portion of the paint container and having a flange at its upper end which projects radially outwardly therefrom and in use rests on the upper end of the cylindrical neck portion of the paint container; and said lid including an annular seal ring sealingly attached to its upper surface about said vent opening, said seal ring projecting upwardly from said lid and terminating in an end surface which, during use, makes sealing contact with the inner side of the closure, about a vent opening in said closure, said seal ring having an open center aligned in communication with both of the vent openings, and said seal ring serving to seal against paint leakage from the liner body into the space between the lid and the closure.

10. For use with a paint sprayer comprising a paint container which is closed at its bottom end and terminates at its top end in an open cylindrical neck portion, a closure for said container, a spray gun mounted on said closure including a draw tube which depends from said closure and in use extends into the paint container, and means for securing the closure to said container; an improved disposable liner for the paint container of the type including:

an annular support collar;

a liner body formed from a thin pliable sheet material and sized to closely fit the interior of said paint container, said liner body including a closed end adapted to rest on the bottom end of the paint container and an open end that is attached to said support member; and a removable lid for said liner which is separate from said liner, comprising a main radial wall, a cylindrical peripheral wall extending upwardly from said main wall and sized to fit downwardly within the support member, a draw tube opening in said main wall surrounded by an annular collar sized to snugly fit about and frictionally grip the draw tube and a vent opening in said main wall; wherein the improvement comprises:

locking means operable between a locked position, for locking the lid to the support collar, so that the lid, the support collar and the liner body can be withdrawn from the paint container by a movement of the closure away from the paint container owing to the frictional grip of said lid on said draw tube, and a unlocked position, in which the lid and the support collar are not locked together and only the lid is removed with the draw tube when the closure is moved away from the paint container; wherein said locking means comprises a plurality of circumferentially spaced apart, inwardly directed, radial, first projections on an upper portion of said support collar, and a plurality of complementary, circumferentially spaced apart, outwardly directed, radial, second projections carried by the lid and interlockable with said radial projections on said support collar with a snap fit.

11. A disposable liner according to claim 10, wherein when said locking means are in said unlocked position said first projections are circumferentially spaced apart from said second projections and when said locking means are in said locked position said first and second projections are circumferentially adjacent each other and are interlocked with each other by a snap fit; and wherein said locking means are movable into said locked position by rotating said lid relative to the support collar to vertically align said first and second projections and then urging said lid downwardly relative to said support collar to interlock said first and second projections with said snap fit.

* * * * *